US011147994B2

(12) United States Patent
Dirksmeier et al.

(10) Patent No.: US 11,147,994 B2
(45) Date of Patent: Oct. 19, 2021

(54) PIPE HEATING INSTALLATION

(71) Applicant: FOGTEC Brandschutz GmbH & Co. KG, Cologne (DE)

(72) Inventors: Roger Dirksmeier, Menden (DE); Ulrich Hiltemann, Wermelskirchen (DE)

(73) Assignee: FOGTEC Brandschutz GmbH, Cologne (DE)

( * ) Notice: Subject to any disclaimer, the term of this patent is extended or adjusted under 35 U.S.C. 154(b) by 257 days.

(21) Appl. No.: 15/759,263

(22) PCT Filed: Sep. 14, 2016

(86) PCT No.: PCT/EP2016/071675
§ 371 (c)(1),
(2) Date: Mar. 12, 2018

(87) PCT Pub. No.: WO2017/046154
PCT Pub. Date: Mar. 23, 2017

(65) Prior Publication Data

US 2018/0250539 A1 Sep. 6, 2018

(30) Foreign Application Priority Data

Sep. 14, 2015 (DE) ..... 10 2015 115 450.1

(51) Int. Cl.
*A62C 13/76* (2006.01)
*A62C 35/02* (2006.01)
*A62C 3/07* (2006.01)

(52) U.S. Cl.
CPC ..... *A62C 13/76* (2013.01); *A62C 3/07* (2013.01); *A62C 35/023* (2013.01)

(58) Field of Classification Search
CPC ..... A62C 3/07; A62C 13/76; A62C 35/023
USPC ..... 239/135
See application file for complete search history.

(56) References Cited

U.S. PATENT DOCUMENTS 3,355,572 A * 11/1967 Chrow ..... F24H 1/142 392/468
3,845,661 A * 11/1974 Hollweck ..... F16J 15/16 374/208
2010/0132963 A1* 6/2010 Sprakel ..... A62C 35/023 169/46

FOREIGN PATENT DOCUMENTS

| | | | |
|---|---|---|---|
| CN | 101411928 | A | 4/2009 |
| DE | 39 38 394 | A1 | 5/1991 |
| GB | 2 449 131 | A | 11/2008 |
| JP | 60-211191 | | 10/1985 |
| JP | 61-200988 | | 12/1986 |
| JP | 2000-130652 | | 5/2000 |
| JP | 2003-117021 | | 4/2003 |

(Continued)

OTHER PUBLICATIONS

The Korean Intellectual Property Office, Notice of Office Action—Application No. 10-2018-7010553, dated Aug. 27, 2018, 45 pages.

(Continued)

*Primary Examiner* — Jason J Boeckmann
(74) *Attorney, Agent, or Firm* — Sunstein LLP

(57) ABSTRACT

Firefighting system 2, comprising a pressure-resistant extinguishing agent container 4, at least one opening arranged in an outer wall of the extinguishing agent container 4, and a pipe 6 arranged in the opening. An enhanced operational readiness is achieved in that a flat heating means at least partly engages around the lateral surface of the pipe.

17 Claims, 6 Drawing Sheets

(56) References Cited

FOREIGN PATENT DOCUMENTS

| | | |
|---|---|---|
| JP | 2003-173864 | 6/2003 |
| JP | 2006-038270 | 2/2006 |

OTHER PUBLICATIONS

The Korean Intellectual Property Office, Notice of Office Action—Application No. 10-2018-7010553, dated Aug. 27, 2018, 8 pages (English translation).
International Searching Authority, International Search Report—International Application No. PCT/EP2016/071675, dated Nov. 28, 2016, together with the Written Opinion of the International Searching Authority, 10 pages (in German).
International Preliminary Examining Authority, International Preliminary Report on Patentability—International Application No. PCT/EP2016/071675, dated Sep. 4, 2017, 11 pages (in German).
The Japanese Patent Office, Notification of Reason(s) for Refusal, Application No. 2018-513490, dated Sep. 14, 2018, 35 pages.
The Japanese Patent Office, Notification of Reason(s) for Refusal, Application No. 2018-513490, dated Sep. 14, 2018, 4 pages (English translation).
National Intellectual Property Administration, People's Republic of China, First Office Action, Application No. 201680053332.3, 8 pages, dated Jan. 6, 2020.
National Intellectual Property Administraion, People's Republic of China, First Office Action, Application No. 201680053332.3, dated Jan. 6, 2020, 11 pages (English translation).

* cited by examiner

PIPE HEATING INSTALLATION

The subject-matter relates to a firefighting system with a heating means.

In mobile firefighting systems which are included by the subject-matter, there is always the danger when aqueous extinguishing agents are used, that the extinguishing agent will freeze. When water is used as the extinguishing agent according to the subject-matter, particularly in high-pressure water mist systems according to the subject-matter, it can happen that the extinguishing agent freezes at very low temperatures, in particular at temperatures below 0° C. This leads to two problems. Firstly, water expands when it freezes, so that there is a risk that the extinguishing agent container, the valve arranged at the outlet of the extinguishing agent container or other devices in the firefighting system will burst. Secondly, it is no longer possible to fight a fire if the extinguishing agent has frozen. Instead, the extinguishing agent firstly has to be thawed out in order to bring the firefighting system into a standby state.

Traditionally, in firefighting systems, as is also the case according to the subject-matter, at least one extinguishing agent container is used in which extinguishing agent, for example water, is stored. Here, there are two systems which are included by the subject-matter, namely firstly so-called one-bottle systems, in which the extinguishing agent is stored permanently under pressure in the extinguishing agent container. This system can be activated independently, without requiring a pump or another propellant to expel the extinguishing agent out of the extinguishing agent container. In so-called two-bottle systems, the extinguishing agent is stored in an unpressurised state in one bottle and a second bottle stores the propellant, in particular a gas propellant, for example nitrogen, under pressure. Upon activation, a valve between the two bottles is opened so that the propellant expels the extinguishing agent out of the extinguishing agent container.

However, both systems run the risk of the extinguishing agent freezing, which must be counteracted. Nowadays, this problem is solved, particularly in the case of high-pressure extinguishing agent containers, by heating mats which are arranged on the outer wall of the extinguishing agent container. However, when steel cylinders are used, as is conventional, as the extinguishing agent containers, so-called steel pressure cylinders, it is necessary to firstly heat the cylinder in order to then heat up the extinguishing agent which is stored inside the cylinder. Since a so-called "liner", an inner plastics layer, is usually arranged on the inner wall inside the steel cylinder, a further insulation layer is present between the heating mat and the extinguishing agent to be heated. On the one hand, this increases the energy consumption in heating the extinguishing agent and, on the other hand, it increases the length of time until the extinguishing agent has been heated up. Furthermore, the liner also limits the energy which is to be introduced, since an excessive flow of energy could result in damage to the liner.

Particularly in the case of the use in rail vehicles, which is also included according to the subject-matter, the operational readiness of the firefighting system must, however, be ensured immediately upon the start-up of the rail vehicle. If the vehicle stands overnight in the cold for example, and the extinguishing agent has frozen, at the start of operation, it is necessary to wait an unnecessarily long time before the rail vehicle can actually be used for passenger transport, namely not until the firefighting system is ready for use, i.e. when the extinguishing agent has thawed out.

It was thus the object of the subject-matter to be able to prepare firefighting systems more quickly for operation, and to keep the extinguishing medium in a liquid state in a more energy-efficient manner.

This object is achieved according to the subject-matter by a firefighting system according to claim 1.

The firefighting system comprises a pressure-resistant extinguishing agent container. An extinguishing agent container of this type can be, for example a steel cylinder in which the extinguishing agent, for example water, can be stored under pressure or without pressure. It is possible to provide in the steel cylinder a so-called liner which protects the inner wall of the steel cylinder against corrosion. Furthermore, the extinguishing agent container can be, for example a composite container, consisting for example of a plastics composite material, preferably of a plastics fibre composite material. Type 4 composite containers are particularly suitable in this respect. The fibre composite materials can be, for example glass fibre composite materials or carbon fibre composite materials.

At least one opening is preferably arranged in the extinguishing agent container. The opening is usually provided as an outlet in the neck of the bottle, but preferably in the case of composite containers, it can be provided in any other area of the extinguishing agent container. The opening can not only be configured as an outlet, but it is also possible that the opening according to the subject-matter is an inlet or is also merely formed as a service opening, via which a heating means and/or a sensor is introduced into the extinguishing agent container. Extinguishing agent can be introduced into the extinguishing agent container via an inlet or, in the case of a two-bottle system, a propellent gas can be propelled into the extinguishing agent container to expel the extinguishing agent out of the extinguishing agent container.

A pipe is preferably arranged in the opening. This pipe is preferably formed as a riser pipe inside the extinguishing agent container, when the opening is the outlet, via which riser pipe the extinguishing agent can be expelled from the extinguishing agent container. The riser pipe leads into an adapter piece at the opening and is converted into an outlet pipe outside the extinguishing agent container. The riser pipe and the outlet pipe can be in one piece and also in several pieces. The adapter piece can preferably be configured as a seal of the pipe at the opening, so that the pipe is guided in a pressure-resistant manner into the interior of the container.

It has been found according to the subject-matter that the extinguishing agent is best heated where the extinguishing agent itself is stored, i.e. directly on the extinguishing agent. In this respect, it is proposed that the heating system is arranged in the interior of the extinguishing agent container. However, to optimise the pressure resistance of the extinguishing agent container, it is advantageous if as few openings as possible are provided in the extinguishing agent container. Since the outlet opening is provided anyway in the extinguishing agent container, the pipe arranged in the opening is preferably provided with a heating means, thereby producing a double pipe of heating means and pipe which is guided through the opening into the interior of the extinguishing agent container.

The heating means is arranged directly on the pipe, so that the pipe and the heating means preferably form an assembly. The flat heating means is arranged on the lateral surface of the pipe and it at least partly engages around the lateral surface. The heating means is preferably formed as a flat part which guides at least one heating resistor in a uniform substrate. In development, the heating means can be a flat part which can be wound around the pipe. Inside the heating means, there are preferably no empty spaces, at least in regions, so that the heating means can be clamped at the opening, in particular by the adapter piece, to thus be able to seal the opening with respect to the heating means together with the pipe.

It has been found that winding a heating means all around the pipe is advantageous when the heating means is formed as a heating sleeve. A heating sleeve can be formed as a flat part, which is preferably formed from a solid material. At least one heating resistor can be guided as a heating coil in the solid material.

According to an embodiment, it is proposed that the heating sleeve fully engages around the pipe. The full engaging around, particularly in part along the longitudinal axis of the pipe, particularly in a region of the opening can ensure that the opening can be sealed. Furthermore, the engaging around provides the largest possible surface of the heating sleeve for heating the extinguishing agent.

According to an embodiment, the heating means can also be formed from a heating wire which is wound around the pipe. The pipe is preferably a riser pipe. The heating means can be wound as a wire-form heating means around the lateral surface of the pipe. The wire-form heating means can also be placed and fastened at least in part inside the pipe.

In addition, the heating sleeve can engage around the pipe at least in the region of the opening and in the interior of the extinguishing agent container. If the heating sleeve engages around the pipe in the interior of the extinguishing agent container, the effective heating surface is maximised. If the heating sleeve engages around the pipe in the region of the opening, it is then possible, as previously described, to seal the extinguishing agent container in a gastight and/or liquid-tight manner between the heating sleeve and the inner circumference of the opening.

According to an embodiment, it is possible for the pipe to form a double-walled pipe with the heating means. The heating means can be an outer pipe which is arranged around the pipe, an annular space preferably being formed between the pipe and the outer pipe. The outer pipe is preferably metallic and at least one, preferably two heating resistors are guided in the annular space between the pipe and the outer pipe. The heating resistor is preferably wound in the annular space between the pipe and the outer pipe.

According to an embodiment, it is proposed that the volume which is not filled by the heating resistor in the annular space is filled with an electrically non-conductive material. Suitable here are preferably non-conductive metal alloys or metal oxides, in particular magnesium alloys or magnesium oxides or oxides of the respective alloys.

According to an embodiment, it is proposed that the heating means is formed form a flat basic body with at least one heating resistor arranged in the basic body. The heating means is preferably formed from a flat part of solid material, in which the heating resistor is guided. For this purpose, the heating resistor can be embedded in the solid material of the basic body. The solid material of the basic body is preferably electrically non-conductive.

According to an embodiment, it is proposed that the heating means is a metallic heating sleeve. Since the heating sleeve is metallic, the opening between sleeve and inner circumference of the opening can be sealed particularly easily, since for example the metallic heating sleeve can be suitably sealed with a compression screw fitting or with an O ring in the same way as the riser pipe arranged in the opening is conventionally sealed.

The sleeve is formed in particular from a non-conductive metal alloy or from a non-conductive metal oxide, for example with a magnesium component. A heating resistor is preferably arranged, preferably embedded in the material of the heating sleeve, and is fully engages around by the material of the heating sleeve.

The heating sleeve or the heating resistor and the material of the heating sleeve are preferably formed from a material which can be deformed plastically without being destroyed. In particular, the deformability is such that the heating sleeve can be wound around the circumference of the pipe without being destroyed. Thus, the pipe or the pipe radius determines the minimum bending radius allowed by the material of the heating sleeve. The heating sleeve is preferably bent or wound around the pipe. In addition to winding the heating sleeve around the pipe, the pipe can be bent inside the extinguishing agent container. Thus, together with the pipe, the heating sleeve can also be bent in the interior of the extinguishing agent container. The pipe is preferably bent in the direction of an outer wall of the extinguishing agent container.

As already mentioned, a riser pipe is usually provided in an extinguishing agent container, particularly if the opening is an outlet opening. In this respect, according to an embodiment, the pipe is a riser pipe.

According to an embodiment, it is proposed that the heating means is arranged on the pipe at least in the region of the opening and in the interior of the extinguishing agent container. Arranging the heating means in the region of the opening allows an easy sealing, and arranging the heating means in the interior of the extinguishing agent container allows the heating means to act directly on the extinguishing agent.

According to an embodiment, it is proposed that a valve is arranged at the opening which is preferably an extinguishing agent outlet. In particular, the riser pipe or the pipe in the interior of the extinguishing agent container leads via the adapter piece into the valve. The pipe can be opened and closed via the valve. The heating means can extend along the pipe from the valve via the opening into the interior of the extinguishing agent container. The heating means thus extends from the valve via the opening into the interior of the extinguishing agent container. The heating resistor can be electrically connected outside the extinguishing agent container, in particular in the region of the valve or of the adapter piece.

The heating means is preferably formed such that it firstly has an electrical feed line which has a lower electrical resistance than in the region in which the heating is to take place. Thus, the heating means preferably has a feed line region and a heating region, both regions preferably being arranged in the same way on the pipe but having different electrical resistances. The feed line region preferably extends by up to 10%, in particular by up to 15% of the pipe length into the interior of the container. This is particularly preferable when the container is only filled with a filling degree of less than 100%, in particular with approximately 90%. Therefore, the heating installation is to be configured such that the upper region is not heated, i.e. the upper region which does not come into contact with the extinguishing agent during operation. The electrical connection in the feed line region should have a minimal electrical power loss.

According to an embodiment, it is proposed that the pipe and the heating means are mounted such that they rest directly against one another. The expression "rest directly against one another" means that there is no air gap in particular between the pipe and the heating means. Preferably provided between the heating means and the lateral surface of the pipe is an adhesive which produces a sealing effect by adhering or sticking the heating means to the pipe.

To be able to fill the extinguishing agent container with extinguishing fluid, without the risk of the extinguishing fluid escaping, and furthermore to be able to build up a gas pressure in the extinguishing agent container, it is necessary to seal the opening. The pipe itself is preferably sealed by the valve. The outer wall of the heating sleeve must be sealed with respect to the opening of the extinguishing agent container. According to an embodiment, this sealing is preferably liquid-tight and/or gastight.

According to an embodiment, the heating means forms, together with the pipe, a double-walled cylinder. The heating means is guided through a seal on its lateral surface at the opening. This allows a seal between the lateral surface of the heating means and the opening or inner circumference of the opening, so that the extinguishing agent container is sealed in a liquid-tight and/or gastight manner at the seal.

As already mentioned, the heating means is preferably a heating resistor. According to an embodiment, this heating resistor can be provided with an electrical connection outside the extinguishing agent container, so that the heating resistor can be supplied with electrical power via this electrical connection.

To achieve the object, a firefighting system is also proposed in which the heating means has at least two heating circuits which can be connected independently of one another. It has been found that the extinguishing agent can be heated, subject to the respective environmental condition, as a result of two heating circuits connectable independently of one another. Here, it is usually possible to prevent the extinguishing agent from cooling down during normal operation by a relatively low power supply. It can suffice using 50 W to a few 100 W of electrical heating power to prevent the extinguishing agent from cooling down at ambient temperatures around the freezing point.

It is also proposed that the heating means is supplied with a differing heating power, said heating power being adapted automatically to the ambient temperatures.

However, during a relatively long standstill of the preferably mobile firefighting installation, for example in a rail vehicle, it is no longer possible to maintain the extinguishing agent in a liquid state at very low temperatures. The extinguishing agent then freezes and has to be rapidly thawed in order to be able to quickly make the firefighting system ready for operation. For this purpose, a second heating circuit can also be switched on or supplied with electrical energy, which second heating circuit can be operated with a higher electrical power than the first heating circuit. Furthermore, electrical heating energy can be supplied, adapted to the environmental conditions, on a case-by-case basis.

In particular, the heating circuits can be operated with heating resistors of different line cross sections. The heating resistor with the smaller line cross section can be configured for the lower electrical power and, due to its corresponding specific resistance, it can convert the electrical energy into heating energy with a good efficiency even with a relatively low electrical power. The heating circuit with the heating resistor of the larger line cross section can be used for the fast heating procedure. In this case, the strength of current in the heating conductor with the smaller line cross section would be too high and the heating conductor would be destroyed. Hence the second heating circuit, which is configured for the higher strengths of current.

The two heating circuits can be connected independently of one another, but they can also be provided simultaneously with electrical power to thus achieve the maximum possible heating power.

According to an embodiment, it is proposed that the heating circuits each have at least one heating resistor. The heating resistor is preferably a heating wire with a specific resistance, respectively adapted to the heating power, and/or line cross section. The line cross section is relevant in particular to the ampacity which preferably differs for the two heating resistors.

According to an embodiment, it is proposed that a first heating resistor has a lower specific resistance than a second heating resistor. The heating resistor with the lower electrical resistance carries the higher electric current and is preferably operated with the higher electrical power. The power loss via the heating resistor which is converted into thermal power is thus higher at this heating resistor than at the heating resistor with the greater specific resistance.

The two heating resistors are preferably configured for the electrical heating power or electric power applied respectively thereto, so that their melting points are preferably different from one another. By means of different heating resistors, it is possible to adapt the heating power to the respective heating power, in particular to the electric power which is respectively fed in.

As already mentioned, the two heating circuits can be operated with a different heating power in each case, in particular with a different electrical power. In this respect, it is expedient to connect a first heating resistor to a first voltage source and to connect a second heating resistor to a second voltage source. At least one of the voltage sources is preferably a direct voltage source.

As already mentioned, the firefighting system according to the subject-matter is suitable in particular for heating the extinguishing fluid in different situations, so that it is advantageous to operate the voltage sources on different electrical voltages, so that the heating resistors are charged with different electrical voltages. In this respect, the voltages are preferably direct voltages.

A low direct voltage, for example a 24 V or a 110 V direct voltage is suitable for maintaining a particular temperature of the extinguishing fluid over a long period of time. The 110 V direct voltage can also be used for thawing purposes, and the 24V can be used for maintaining the liquid state. Both voltages can be fed, for example from an accumulator. A second direct voltage can preferably be a voltage supply of an on-board supply system. In particular, a second direct voltage can be 380 V or 400 V. The higher voltage can be pulsed, for example, to control the heating energy.

The heating circuits are preferably encapsulated in a common housing of the heating means. In particular, the heating circuits are arranged in the heating sleeve. The heating means can be arranged in and/or on the extinguishing agent container. In particular, the heating sleeve can be arranged on a riser pipe inside the extinguishing agent container. It is also possible for the heating sleeve to be arranged on the outer lateral surface of the extinguishing agent container, in particular it is possible for it to be wound around the extinguishing agent container in the form of a heating mat.

Heating means can also merely be arranged on the adapter or on the adapter head in the region of the opening of the extinguishing agent container. If the heating means is merely arranged outside the extinguishing agent container, an improved thermal conductivity of the pipe, in particular of the riser pipe, can be used for a better thermal transport. For this reason, it is also proposed that the riser pipe is formed from a metal material, preferably from a copper material which has an increased thermal conductivity compared to a riser pipe made of stainless steel. The arrangement of the heating means only on the adapter head should be regarded as independent, but it can be combined with all other features, as described here.

According to an embodiment, it is proposed that at least one temperature sensor is arranged in or on the extinguishing agent container. By means of the temperature sensor, it is possible to detect the temperature of the extinguishing agent container and/or the temperature of the extinguishing agent. The switching-on of the heating means can be controlled by evaluating the temperature measured by the temperature sensor.

For this reason, according to an embodiment it is proposed that a control means controls the charging of the heating resistors with electrical voltage, subject to a temperature detected by at least one temperature sensor. A hysteresis, for example, can be programmed into the control means, so that upon falling below a limiting temperature, a heating circuit is switched on, and upon exceeding a second limiting temperature which is higher than the first limiting temperature, the heating circuit is switched off again.

For use in firefighting systems, preferably in high-pressure water mist systems, the extinguishing agent container must be pressure-resistant. Here, in particular a pressure resistance of 5 bar, preferably 50 bar, in particular 100 bar is possible.

A further aspect is a method for operating a firefighting system. In this method, at least one temperature of the extinguishing agent container and/or of the extinguishing agent in the extinguishing agent container is recorded. If the measured temperature falls below a first limiting temperature, only the first heating circuit is initially activated. If the measured temperature falls below a second limiting temperature, lower than the first limiting temperature, the second heating circuit is activated. The second heating circuit can be activated cumulatively or alternatively to the first heating circuit.

By forming a hysteresis control, upon exceeding the second limiting temperature, the second heating circuit can initially remain activated, until a third limiting temperature which is higher than the second limiting temperature is attained and only then is the second heating circuit deactivated. A hysteresis control can also be established for the first limiting temperature or for the first heating circuit, so that only upon exceeding a fourth limiting temperature which is higher than the first limiting temperature, is the first heating circuit deactivated.

When the heating circuits are activated, they are each charged with electrical voltage. In particular, one of the electrical voltages can be an on-board supply system of a rail vehicle.

For use at different temperatures of the extinguishing agent, it makes sense for the first heating circuit to be operated with a lower heating power than the second heating circuit.

In the following, the subject-matter will be described in more detail with reference to drawings showing embodiments, in which drawings.

Figure 3A:
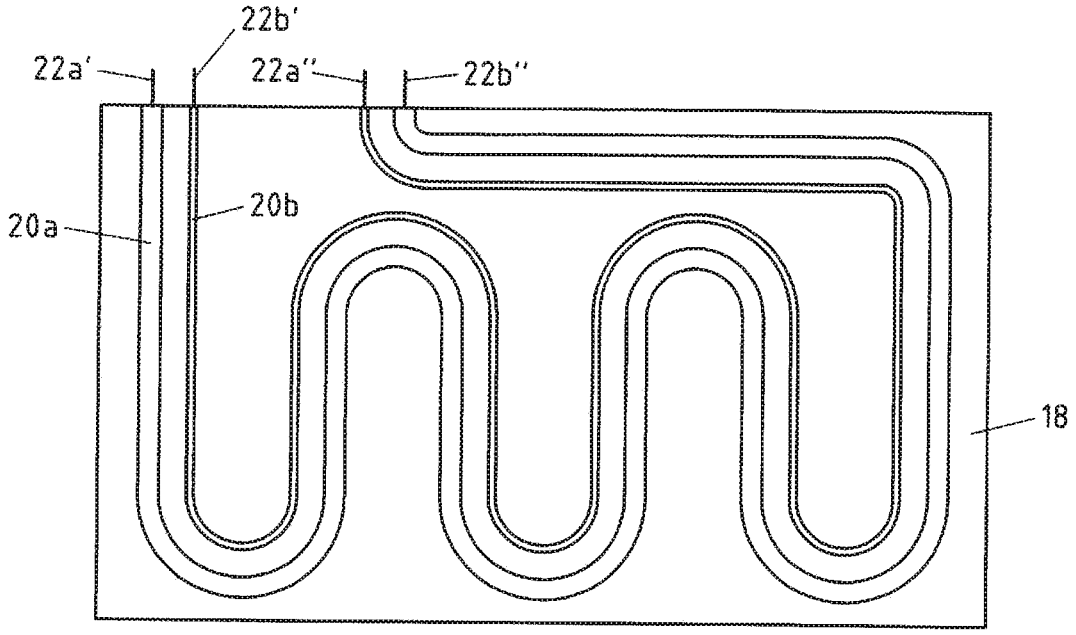
Figure 3B:
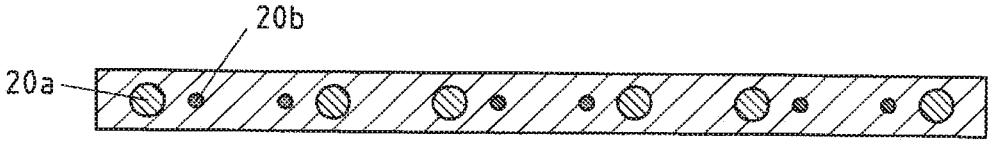
Figure 4:
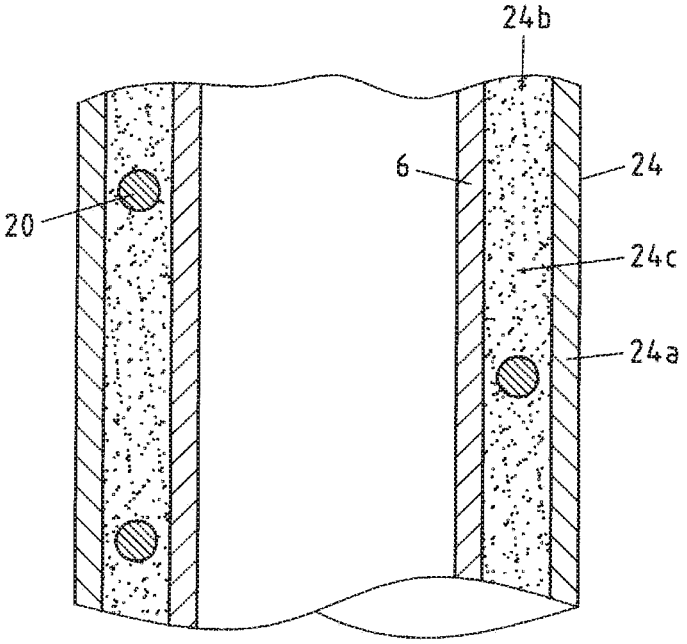
Figure 5:
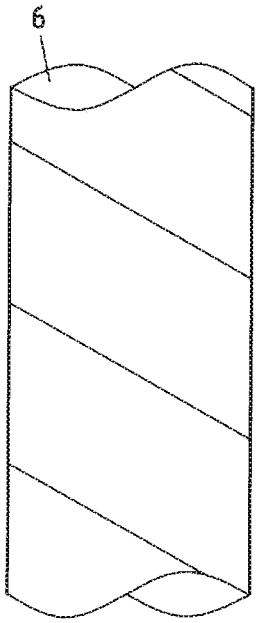
Figure 6:
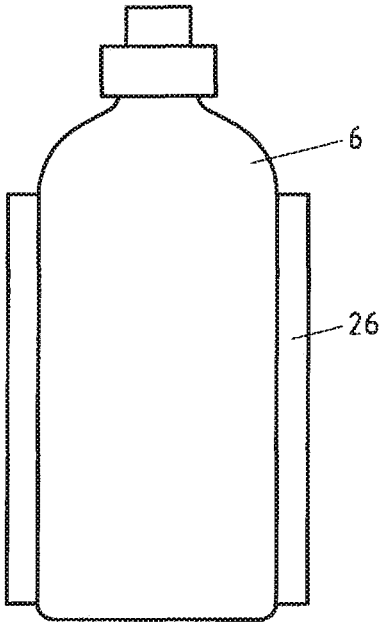
Figure 7:
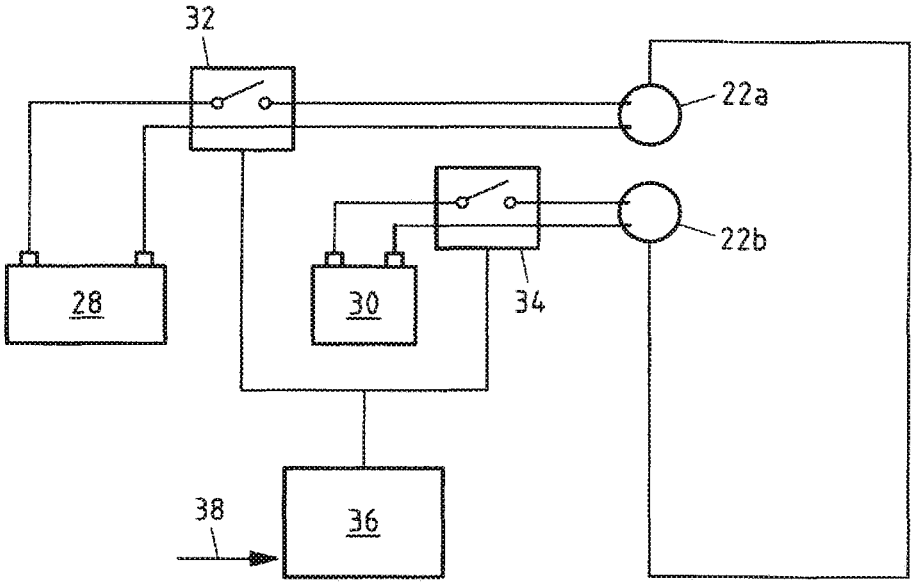
Figure 8:
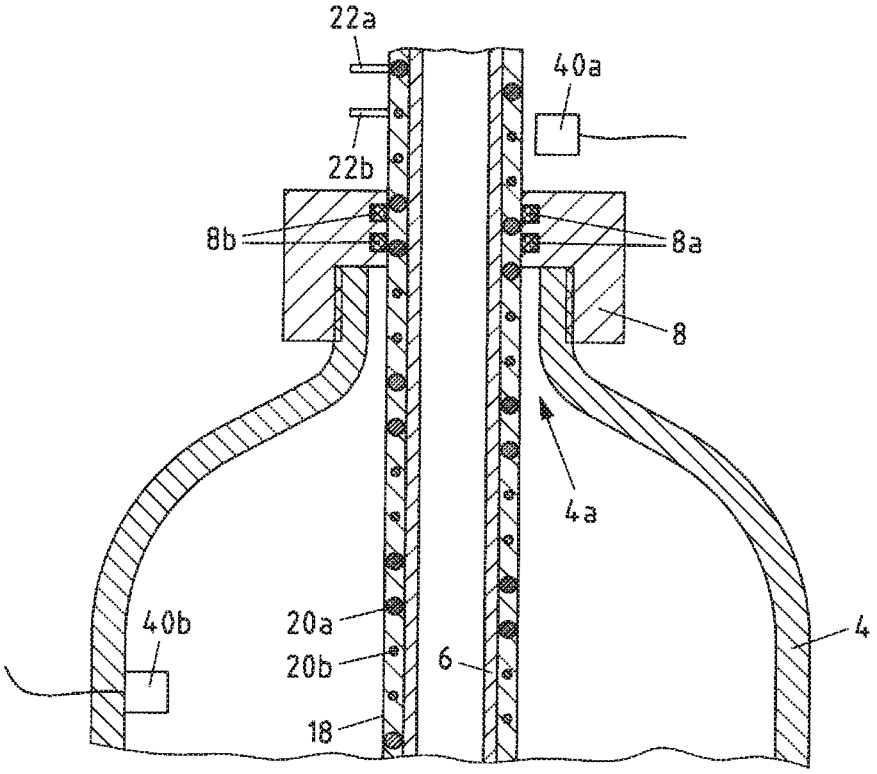
Figure 9:
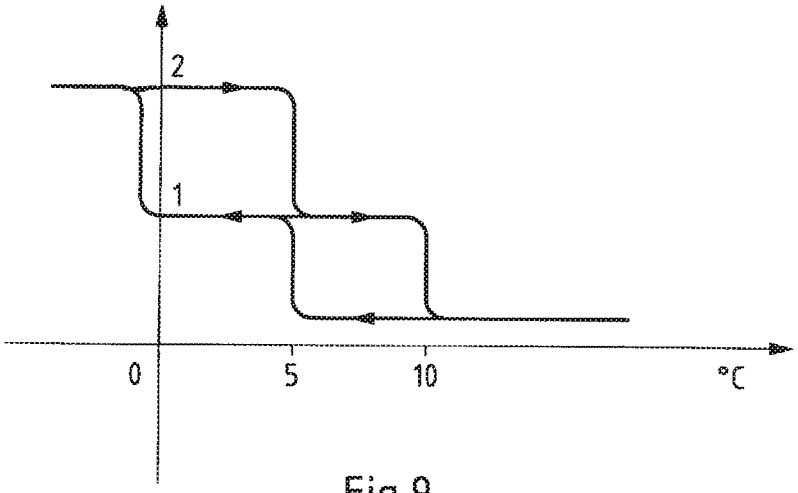
Figure 10:
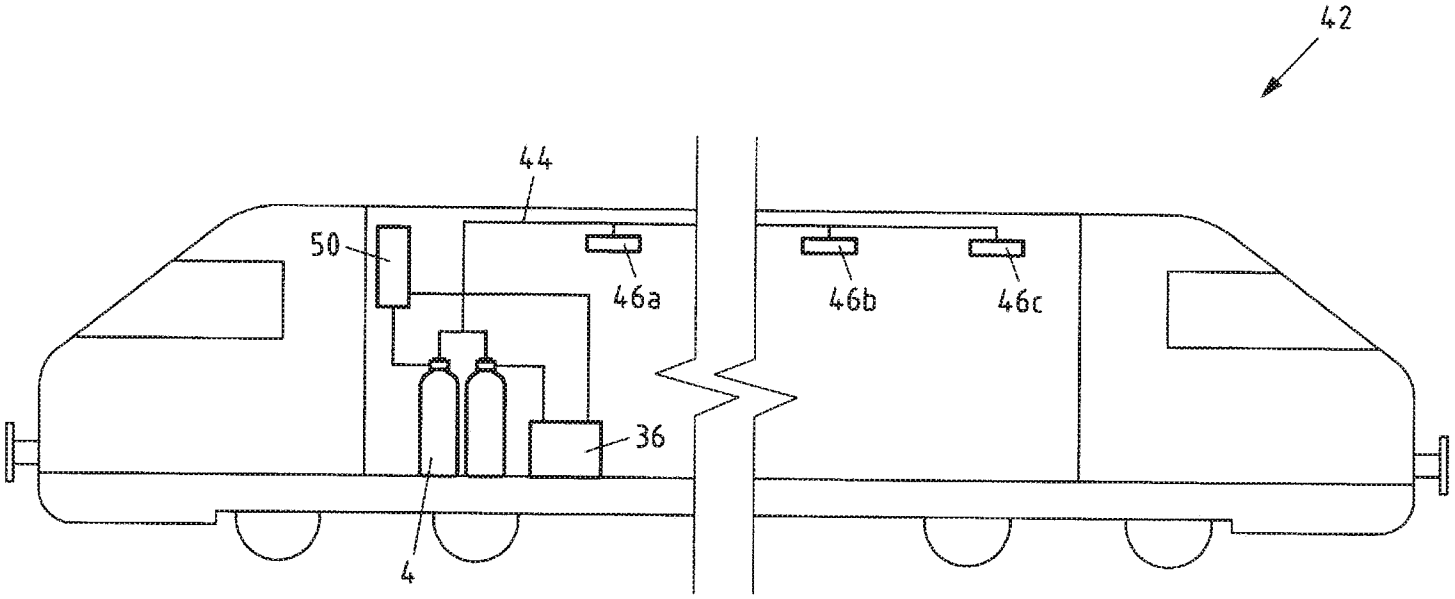

FIG. 3*a* is a schematic plan view of a heating sleeve;

FIG. 3*b* is a sectional view of a heating sleeve;

FIG. 4 is a sectional view of a further embodiment of a heating means;

FIG. 5 shows the winding of a heating means around a pipe;

FIG. 6 shows an arrangement of a heating means on an extinguishing agent container;

FIG. 7 shows a schematic arrangement of an electrical heating means with a voltage supply;

FIG. 8 is a schematic view of an outlet together with temperature sensors and riser pipe;

FIG. 9 shows a mode of operation of a firefighting system according to the subject-matter;

FIG. 10 is a schematic view of a rail vehicle with a firefighting installation according to the subject-matter.

Figure 1:
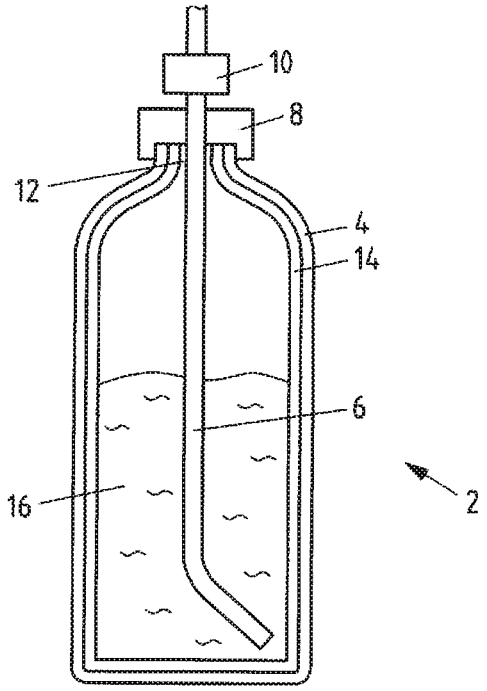
FIG. 1 shows a firefighting system.

FIG. 1 shows a firefighting system 2 with an extinguishing agent container 4. Provided in the extinguishing agent container 4 is a riser pipe 6 which leads into a valve 10 via an adapter piece 8. The adapter piece 8 is arranged in the region of an outlet opening 12 of the extinguishing agent container 4 and is screwed therein preferably in a sealing manner.

In the variant which is shown, the extinguishing agent container 4 is a steel cylinder which has a plastics liner 14 on its inner surface to protect the material of the extinguishing agent container 4 against corrosion. Extinguishing fluid 16, here in the form of water, is stored under pressure in the extinguishing agent container 4. The extinguishing agent container 4 is preferably in standby mode at a resting pressure of more than 5 bar, preferably more than 20 bar, in particular more than 100 bar. By opening the valve 10, the extinguishing fluid 16 is expelled from the extinguishing agent container 4 via the riser pipe 8 and can then be applied, for example via a high-pressure water mist system or via corresponding high-pressure mist nozzles. However, it is also conceivable for the present firefighting system to be used in conventional sprinkler systems, because they also suffer from the problem of freezing.

The heating installation according to the subject matter can be used in the firefighting system 2 which is shown.

Figure 2:
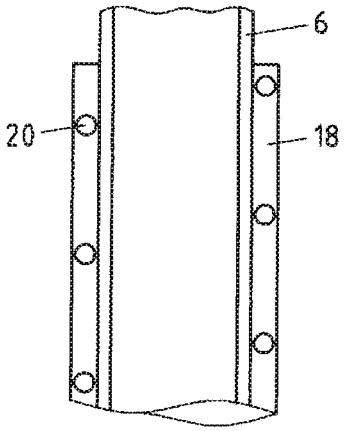
FIG. 2 is a schematic view of a pipe with a heating sleeve.

FIG. 2 shows the riser pipe 6 which is sheathed by a heating sleeve 18. The heating sleeve 18 is directly connected, for example adhesively bonded, to the outer wall of the pipe 6. The connection between heating sleeve 18 and riser pipe 6 is preferably such that no gap is formed between the outer wall of the pipe 6 and the heating sleeve 8. In particular, the connection between heating sleeve 18 and riser pipe 6 is such that no gas or liquid can flow between the heating sleeve 18 and riser pipe 6.

As can be seen, at least one heating resistor 20 is provided in the heating sleeve 18. The heating resistor 20 is encapsulated in the heating sleeve 18 and, in the assembled state, is wound around the riser pipe. The material of the heating sleeve 18 is preferably a solid material, in particular it is formed from a non-conductive metal alloy or from a non-conductive metal oxide. At least one heating resistor 20 in the form of a heating wire is guided in the interior of the heating sleeve 18. Due to the insulating characteristic of the material of the heating sleeve 18, the heating resistor/resistors 20 can be guided directly in the material of the heating sleeve 18.

FIG. 3*a* is a plan view of a development of a heating sleeve 18. Two heating resistors 20*a*, 20*b* which can be connected separately from one another are guided in the heating sleeve 18. It can be seen that the heating resistors 20*a*, 20*b* each have two electrical connections 22 (22*a*', 22*a*" and 22*b*', 22*b*"). The heating resistors 20*a*, 20*b* which can be configured as heating wires can be charged via these two respective electrical connections 22 with a respective electrical voltage, which can also be different. The electrical power fed into the heating resistors 22*a*, 22*b* can be different, so that the heating resistors 22*a*, 22*b* can have different heating powers.

The heating sleeve 18 can be wound around the riser pipe 6 if the material of the heating sleeve 18 and of the heating resistors 22*a*, 22*b* is plastically deformable. In particular, a minimum bending radius can be preset by the outer radius of the riser pipe 16. The material of the heating sleeve 18 and of the heating resistors 20*a*, 20*b* should be plastically deformable without being destroyed up to such a bending radius.

FIG. 3*b* shows a cross section through a heating sleeve 18. It can be seen that the conductor cross sections of the heating resistors 20*a*, 20*b* can vary in size, which results in different heating powers, in particular in different ampacities. The melting points of the materials of the heating resistors 20*a*, 20*b* can also be different.

FIG. 4 shows a further embodiment of a heating means 24 on a riser pipe 6. It can be seen that the heating means 24 is formed from an outer pipe 24*a* and filler material 24*c* arranged in an annular space 24*b* between the outer pipe 24*a* and the riser pipe 6, as well as at least one heating resistor 20. The filler material 24 is preferably electrically non-conductive and thus insulates the heating resistor 20. On the other hand, the material preferably has a good thermal conductivity, so that the heating power of the heating resistor 20 can be released to the extinguishing agent 16 via the outer pipe 24*a* without a significant time delay.

A heating sleeve 18, as shown in FIG. 3*a*, can be coiled or wound around the riser pipe 6 in the form shown in FIG. 5.

Furthermore, a heating wire can be wound around the pipe. A single heating wire can be wound around the riser pipe. The heating wire can be formed from an outer layer with a non-conductive oxide, and inside it can have the actual heating element with an electrically conductive wire. The heating wire is preferably plastically deformable, whereby a bending radius, by which the wire can be bent in a destruction-free or injury-free manner, can approximately correspond to the external radius of the pipe. The heating wire per se is so flexible that it can be wound around the riser pipe.

Alternatively, it is also possible that the wire is not fitted directly on the pipe, but on a holder fastened to the pipe.

The heating means do not necessarily have to be arranged on the riser pipe 6, but they can also be arranged on the adapter piece 8 (not shown) as well as on the outer lateral surface of the extinguishing agent container 6. FIG. 6 shows a heating mat 26 which has two switching resistors 20 (not shown) which can be switched separately from one another. Via electrical connections 22 (not shown) which can be respectively equipped separately from one another, the heating resistors can be operated at different times and with different electrical powers, so that only one heating resistor or alternatively two heating resistors can be operated, depending on a temperature of the extinguishing agent container 6 or of the extinguishing agent 16 stored in the extinguishing agent container 6.

FIG. 7 shows the connection and disconnection of the electrical supply to the heating resistors 20*a*, 20*b*. In FIG. 7, for example a 24 V direct voltage supply 28 is shown as an accumulator battery. Provided next to this is a rectifier 30 which is connected to the voltage supply of the vehicle, for example a rail vehicle, and provides an electrical direct voltage of 380 V or 400 V via its outputs. The accumulator battery 28 and the rectifier 30 are connected to the electrical connections 22 of the heating resistors 20*a*, 20*b* (not shown) via respective switches 32, 34.

From a temperature sensor (not shown), a control circuit 36 receives a temperature signal 38 which it evaluates. Based on the evaluation of the temperature signal 38, the control circuit 36 opens or closes the switches 32, 34. Thus, upon falling below a first limiting temperature, for example 10° C., the switch 32 can be closed, while the switch 34 remains open. The heating resistor 20*a* is operated with a relatively low electrical power, and the temperature of the extinguishing agent 16 is merely maintained. However, if the outside temperature falls further, this low heating power will be inadequate. The temperature of the extinguishing agent 16 then falls below a second limiting temperature. Even during a complete disconnection of the two heating systems, for example, during the operational standstill of the vehicle, the temperature of the extinguishing agent 16 can fall below the second limiting temperature which is lower than the first limiting temperature. Such a temperature triggers a corresponding temperature signal 38 which is evaluated by the control circuit 36 so that the switch 34 is closed. The switch 34 can be closed cumulatively to switch 32 or alternatively to switch 32.

When switch 34 is closed, the heating resistor 20*b* is provided with electrical power from the rectifier 30, this electrical power being significantly greater than the power from the accumulator 28. This leads to a higher thermal dissipation in the heating resistor 20*b*, which results in the extinguishing fluid 16 being heated up faster. In particular, if the extinguishing fluid is frozen, for example if the temperature signal 38 registers a temperature value of 0° C., a rapid heating procedure of this type can be activated.

FIG. 8 shows a detail view of an opening 4*a* in an extinguishing agent container 4. It can be seen that the adapter piece 8 is screwed with the mouth of the opening 4. A first temperature sensor 40*a* can be arranged outside the adapter piece 8. A second temperature sensor 40*b* can be arranged in the interior of the extinguishing agent container 4. The temperature sensors 40*a*, 40*b* can transmit a temperature signal 38 to the control means 36.

It is also possible for the heating wire to be released from the riser pipe in the region of the opening 4*a* and for it to be guided outwards, sealed separately, through the valve body and for it to be connected there to the energy source. The inner heating element, for example the heating wire can either be guided outwards through the valve body or internally in the riser pipe. On the valve, the heating wire can have an electrical connection to the voltage supply, it being possible to use a pressure-resistant closure with an external plug connector. The electrical connection can then be realised on the outside.

Furthermore, it can be seen that the heating sleeve 18 is arranged directly on the riser pipe 6. The riser pipe 6, together with the heating sleeve 18 which is preferably formed from metal at least on its outer surface, is guided through the adapter piece 8. The heating sleeve 18 is received in a sealing manner in the adapter piece 8, which is indicated schematically by the O rings 8*a* and 8*b*. The seal is sufficiently well-known and is therefore not described in more detail. Provided outside the extinguishing agent container 4 are the electrical connections 22*a* and 22*b*, via which the heating resistors 20*a*, 20*b* of the heating sleeve 18 can be electrically contacted.

To reduce the switching frequency and to allow a frozen extinguishing agent container 4 to be reliably thawed out, the heating resistors 20*a*, 20*b* are operated with a hysteresis. In FIG. 9, a temperature value is plotted in ° C. on the X-axis. Furthermore, the switching states 1 and 2 are plotted on the Y-axis. Switching state 1 means that only one heating resistor is activated and switching state 2 means that both heating resistors are activated, i.e. they are charged with electrical power. When the temperature falls, for example upon reaching a temperature of 5° C., a first heating resistor is activated. For example, this can be the resistor which is charged with the lower electrical power.

As long as the temperature ranges between 0 and 10° C., the first heating resistor will remain connected. Only when the temperature exceeds 10° C. is switching state 1 exited and the first heating resistor is disconnected again.

However, if the temperature in switching state 1 falls further and reaches 0° C., for example, switching state 2 is connected. In switching state 2, both heating resistors are preferably charged with electrical power, the second heating resistor being charged with a significantly higher electrical power than the first heating resistor. If the temperature falls even further, switching state 2 remains. However, the second heating resistor is only deactivated again when the temperature exceeds 5° C. The switching frequency is reduced by this hysteresis.

FIG. 10 shows a rail vehicle 42 with a pipeline system 44 and water mist nozzles 46*a-c*. The pipeline system 44 is connected to two extinguishing agent containers 4. The extinguishing agent containers 4 are controlled by a central control means 36 which is connected to a fire alarm centre (not shown). In the event of a fire, the valves 10 are opened via the central control 36 and extinguishing agent passes out of the nozzles 46*a-c*.

The control means 36 also monitors a temperature of the extinguishing agent container 4 and, based on the temperature, controls an energy supply 50 which is coupled, for example, to the central energy supply of the rail vehicle 42. The extinguishing agent containers or the heating systems therein are controlled as described above.

LIST OF REFERENCE NUMERALS

2 firefighting system
4 extinguishing agent container
6 riser pipe
8 adapter
10 valve
12 outlet opening
14 liner
16 extinguishing fluid
18 heating sleeve
20 heating resistor
22 electrical connections
24 heating means
24*a* outer pipe
24*b* annular space
24*c* filler material
28 battery
30 rectifier
32, 34 switches
36 control circuit
38 temperature signal
40 temperature sensor
42 rail vehicle
44 pipeline system
46 nozzles
50 energy supply

The invention claimed is:

1. Firefighting system comprising:

a pressure-resistant extinguishing agent container;

at least one opening arranged in an outer wall of the extinguishing agent container;

a pipe arranged in the opening; and a heating sleeve completely engaged around the pipe and extending into the interior of the extinguishing agent container, wherein a temperature sensor is arranged to sense the temperature of the extinguishing agent within the extinguishing agent container and to switch on the heating sleeve to thaw the extinguishing agent.

2. Firefighting system of claim 1, wherein the heating sleeve includes a heating wire wound around the pipe.

3. Firefighting system of claim 1, wherein the heating sleeve is formed from an outer pipe which is arranged around the pipe, the outer pipe being metallic and wherein at least one heating resistor being guided in an annular space between the pipe and the outer pipe.

4. Firefighting system of claim 3, wherein the annular space is filled with a filling of an electrically non-conductive material.

5. Firefighting system of claim 1, wherein the heating sleeve is formed from a flat basic body with at least one heating resistor arranged in the basic body.

6. Firefighting system of claim 1, wherein the heating sleeve is formed from a non-conductive metal alloy with at least one heating resistor arranged therein.

7. Firefighting system of claim 1, wherein the heating sleeve is plastically deformable without being destroyed, the heating sleeve being bent around the pipe, and/or the heating sleeve, together with the pipe, being bent in the interior of the extinguishing agent container.

8. Firefighting system of claim 1, wherein the pipe is a riser pipe.

9. Firefighting system of claim 1, wherein the heating sleeve is arranged on the pipe at least in the region of the opening and in the interior of the extinguishing agent container.

10. Firefighting system of claim 1, wherein a valve is arranged on the opening which is preferably an extinguishing agent outlet, and/or the heating sleeve extends on the pipe from the valve via the opening into the interior of the extinguishing agent container.

11. Firefighting system of claim 1, wherein the pipe and the heating sleeve rest directly against one another, and in that the heating sleeve is adhesively bonded onto the lateral surface of the pipe.

12. Firefighting system of claim 1, wherein the pipe and the heating sleeve are interconnected in a liquid-tight and/or gastight manner.

13. Firefighting system of claim 1, wherein the heating sleeve, together with the pipe, forms a double-walled cylinder, and a lateral surface of the heating sleeve is guided through a seal at the opening, so that the extinguishing agent container is sealed in a liquid-tight and/or gastight manner at the seal.

14. Firefighting system of claim 3, wherein the heating sleeve has outside the extinguishing agent container an electrical connection of the at least one heating resistor.

15. Firefighting system of claim 5, wherein the heating sleeve has outside the extinguishing agent container an electrical connection of the at least one heating resistor.

16. Firefighting system of claim 6, wherein the heating sleeve has outside the extinguishing agent container an electrical connection of the at least one heating resistor.

17. Firefighting system of claim 1, wherein the pipe and the heating sleeve rest directly against one another, and in that the heating sleeve is received in the region of the opening, sealing the extinguishing agent container.

* * * * *